US006209381B1

(12) United States Patent
Yaguchi et al.

(10) Patent No.: US 6,209,381 B1
(45) Date of Patent: Apr. 3, 2001

(54) METHOD AND SYSTEM FOR CHAMFERING AND PRESS THEREFOR

(75) Inventors: Tetsuo Yaguchi; Hiroshi Ikemoto, both of Kitaazumi-gun; Yuji Yagisawa, Tochigi, all of (JP)

(73) Assignees: Kuroda Precision Industries, Kanagawa; Tochigi Fuji Sangyo Kabushiki Kaisha, Tochigi, both of (JP)

( * ) Notice: Subject to any disclaimer, the term of this patent is extended or adjusted under 35 U.S.C. 154(b) by 0 days.

(21) Appl. No.: 09/349,048

(22) Filed: Jul. 7, 1999

(30) Foreign Application Priority Data

Jul. 8, 1998 (JP) ..... 10-193428

(51) Int. Cl.[7] ..... B21D 19/00
(52) U.S. Cl. ..... 72/416; 72/407; 72/335
(58) Field of Search ..... 72/416, 407, 335, 72/355.2, 355.4

(56) References Cited

U.S. PATENT DOCUMENTS

| | | | | |
|---|---|---|---|---|
| Re. 23,939 | * | 2/1955 | Keller | 72/355.4 |
| 2,438,837 | * | 3/1948 | Archer | 72/355.4 |
| 3,796,086 | * | 3/1974 | Phillips | 72/416 |
| 3,803,898 | * | 4/1974 | Speakman | 72/416 |
| 3,895,922 | * | 7/1975 | Phillips | 72/377 |
| 4,248,075 | * | 2/1981 | Whitley | 72/325 |
| 4,821,388 | * | 4/1989 | Okumura | 72/126 |
| 5,024,075 | * | 6/1991 | Simonetto | 72/342.94 |
| 6,018,977 | * | 2/2000 | Kanno | 72/355.4 |

FOREIGN PATENT DOCUMENTS

| | | | | |
|---|---|---|---|---|
| 2024054 | * | 1/1980 | (GB) | 72/335 |
| 3-124027 U | | 12/1991 | (JP) . | |
| 6-141516 | | 5/1994 | (JP) . | |

* cited by examiner

*Primary Examiner*—Daniel C. Crane
(74) *Attorney, Agent, or Firm*—Morrison & Foerster

(57) ABSTRACT

In a vertical press that simultaneously forms chamfers at edges on both sides of a punched sheet material by using an upper chamfering punch and a lower chamfering punch, the lower chamfering punch is supported by conical disc springs piled on a support base.

11 Claims, 8 Drawing Sheets

SLIDE DOWN
BACK PRESS
LOWER DEAD POINT
Sa
Sb
3
5
9
13
15
25U
25L

METHOD AND SYSTEM FOR CHAMFERING AND PRESS THEREFOR

BACKGROUND OF THE INVENTION

1. Field of the Invention

The present invention relates to a method and a system for chamfering, and to a press therefor. More specifically, the invention relates to a chamfering method and a chambering system for chamfering a material, illustratively a plate or sheet blanked or punched by a press, and to a press therefor.

2. Description of the Related Art

There is disclosed a chamfering method in Japanese Patent Application Laid-Open Publication No. 6-14151 (hereinafter referred to as "first related art").

In the first related art, a core plate is laminated to form a core of a rotor of an electric motor, chamfers are formed on an upper surface of an uppermost core plate and a lower surface of a lowermost core plate, respectively, of the core. Because only the outside surfaces of the uppermost and lowermost core plates and arc subject to chamfering, and because a pressing operation is used in the sequence of laminating each of the core plates, separate chamfering operations are performed to form the chamfers on the uppermost and lowermost core plates.

Depending upon application of the member, there are of course cases in which both surfaces of the punched part will be chamfered. For example, in Japanese Utility Model Application Laid-Open Publication No. 3-124027 (hereinafter referred to as "second related art"), there is disclosure of clutch plates which are used in a coupling that transmits power via the viscous resistance of a fluid. The clutch plates each have chamfers formed at both sides thereof.

In the case of the second related art, chamfers of predetermined dimensions are formed at both surfaces of a clutch plate blank by the action of a fixed lower punch and an upper punch that has the same shape on its end part as the lower punch and is slide-dropped thereonto.

When the press chamfering operation is continued for a long period of time, however, because of such factors as thermal expansion of the press itself and the dies, minute variations in the bottom dead point (stroke end point) of the slide-dropped upper punch occur, this being accompanied directly by variations in the chamfer dimensions. In the case of the first related art, burrs may remain on the motor core plates, leading to a damage on winding wires. In the case of the second related art, the clutch plate in the coupling may get adhered to the adjacent clutch plate because of a hump. To avoid such problems, it is important to perform the troublesome task of maintaining control of accuracy of the bottom dead point of the upper punch.

SUMMARY OF THE INVENTION

The present invention has been achieved with such points in view.

It therefore is an object of the invention to provide a chamfering method and a chamfering system that can minimize a potential influence of chamfering stroke accuracy on chamfer dimensions to eliminate conventional drawbacks, as well as a press therefor.

To achieve the object, an aspect of the invention provides a chamfering method comprising chamfering a material, resiliently supporting the material.

Another aspect of the invention provides a chamfering system comprising a chamfering mechanism for chamfering a material, and a support mechanism for resiliently supporting the material to be chamfered by the chamfering mechanism.

Another aspect of the invention provides a press for simultaneously forming chamfers at edges on both sides of a material using a pair of chamfering punches to exert chamfering pressures thereon, wherein the press includes a pair of chamfering punches either resiliently supported.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
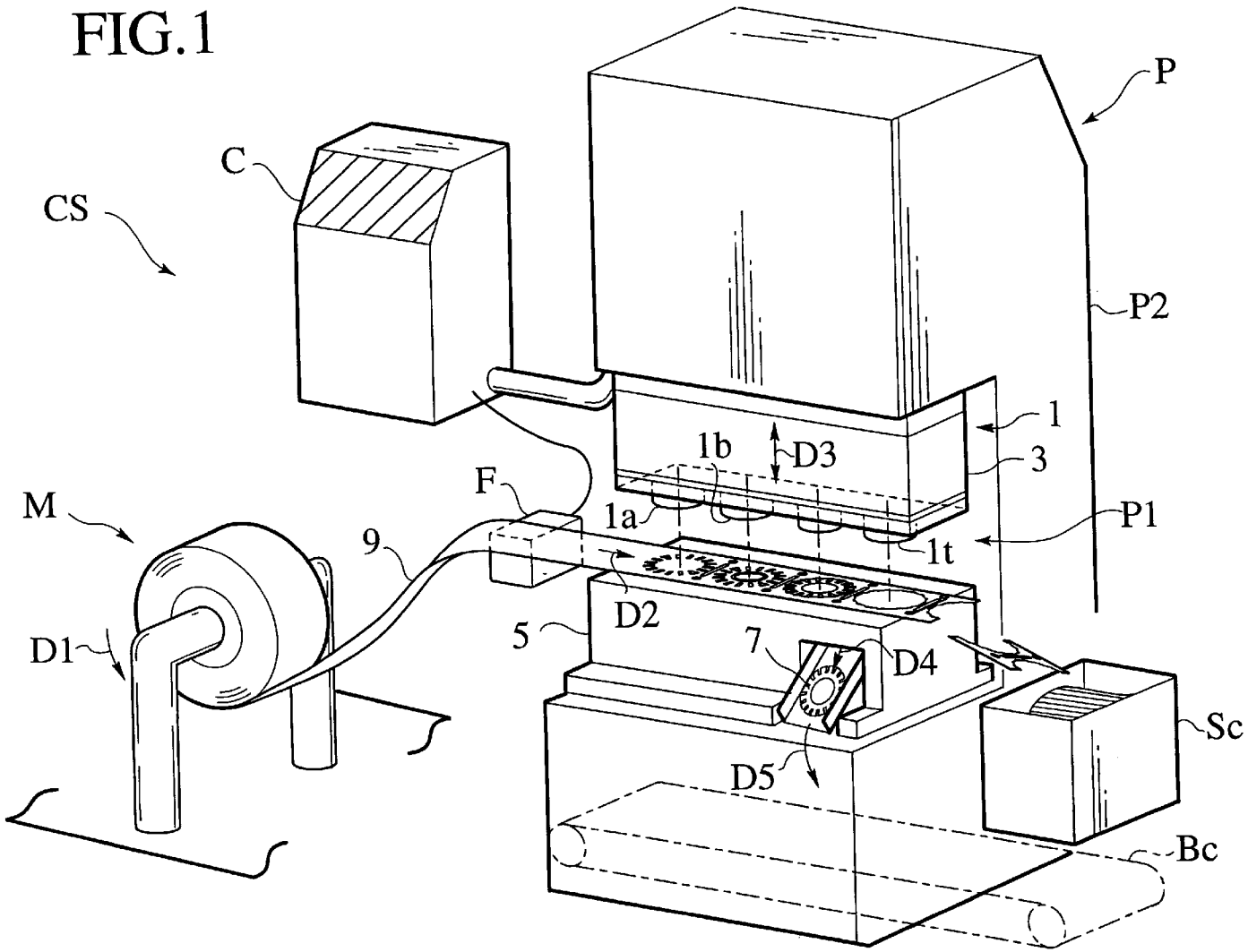
FIG. 1 is a perspective view of an installation as a chamfering system including a press according to an embodiment of the invention.

There will be detailed below the preferred embodiments of the present invention with reference to the accompanying drawings. Like members are designated by like reference characters.

FIG. 1 shows a chamfering system CS according to an embodiment of the invention.

The system CS comprises a material supply M as a roll of a sheet material 9 to be unrolled (in a unroll direction D1) for supply, a press P having an incorporated die assembly (hereafter sometimes simply called "die") 1 of a progressive type, and a controller C responsible for an entirety of the system, in particular for a synchronous operation of the press P.

The press P comprises a continuous processing line P1 and a press machine section P2 with drives and controls therefor.

The processing line P1 comprises an intermittent feeder F for intermittently feeding a thin plate or sheet as the material 9 (in a horizontal direction D2), the die assembly 1 constituted with a pair of upper (or top) and lower (or bottom) elongate dies 3, 5 in which the upper die 3 is actuated (in a vertical direction D3), a belt conveyor Bc for transfer of so-called inner plates as discharged products 7 (in a direction D5), and a blanked-scrap collector Sc.

The die assembly 1 has a number of partially shown cascaded (and paralleled if necessary) punching stations in a form of progressively arranged (or step-forwarding) die portions including a pilot hole blanking die section (1*p*, FIG. 2), a slot blanking die section (1*q*, FIG. 2), a slit blanking die section 1*a*, a chamfer punching die section 1*b*, an ID (inside diameter) blanking die section (1*r*, FIG. 2), an OD (outside diameter) blanking die section (1*s*, FIG. 2), and a discharging die section portion (1*t*, FIG. 2) for discharging blanked, chamfered and punched-out products 7 one by one (in a discharge direction D4). Each punching station comprises one or more die sections each constituted with a necessary number of punches fixed to the upper die 3 and a corresponding number of die blocks installed in the bottom die 5. The number of punching stations may be longitudinally and transversely increased or decreased in accordance with that of processing steps and a production rate of products 7.

Figure 2:
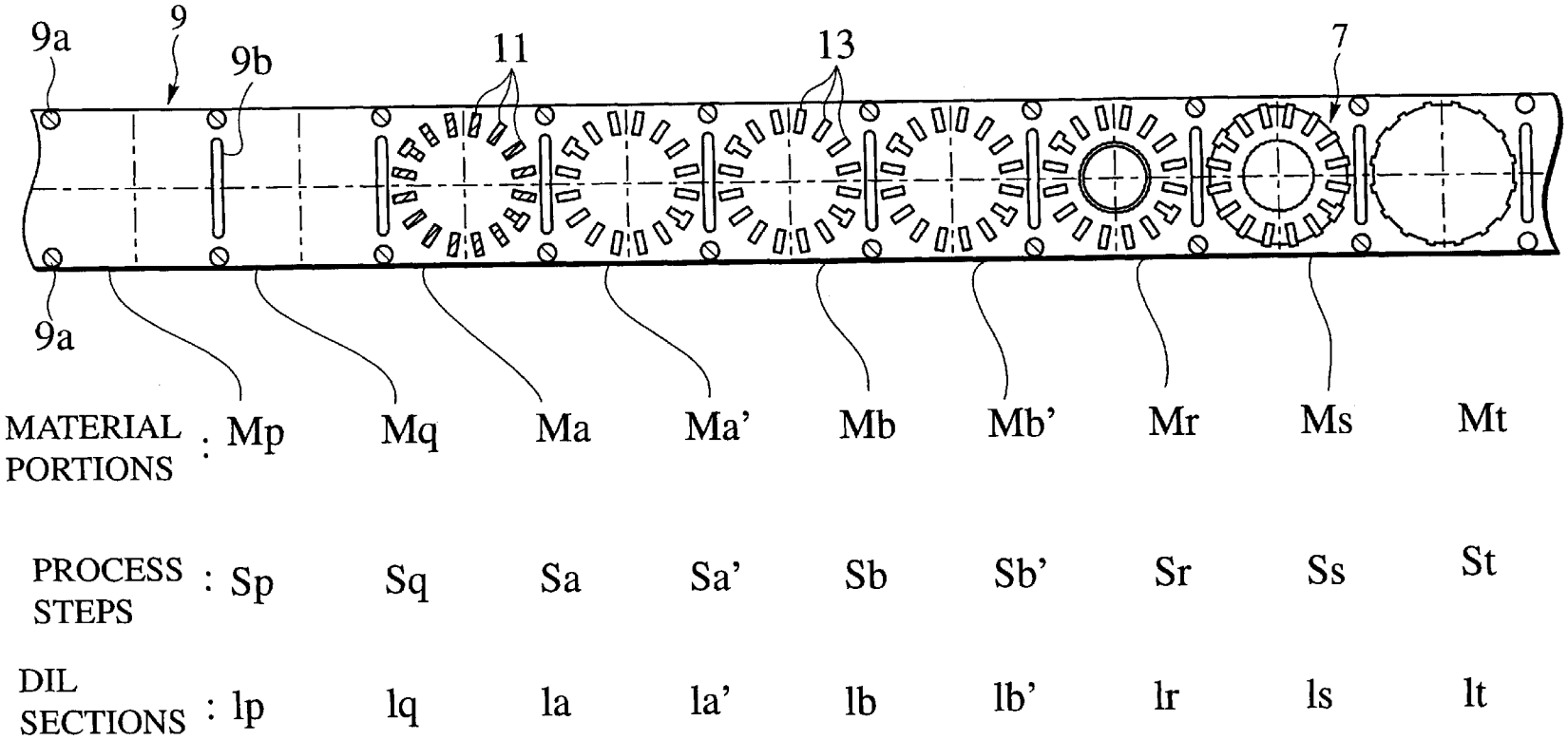
FIG. 2 is a plan of a material on a way of processing in the press of FIG. 1.

FIG. 2 shows a length of the material 9 that is associated with the die assembly 1 of FIG. 1, and has a series of material portions Mp, Mq, Ma, Ma', Mb, Mb', Mr, Ms and Mt each respectively simultaneously or synchronously processed in a corresponding one of process steps Sp, Sq, Sa, Sa' (shift), Sb, Sb' (shift), Sr, Ss and St at an associated one of die sections 1*p*, 1*q*, 1*a*, 1*a*' (punch-less), 1*b*, 1*b*' (punch-less), 1*r*, 1*s* and 1*t*.

As shown in FIGS. 2 and 4A to 4D, the die 1 constituted with upper die 3 and bottom die 5 has a length of sheet material 9 stepwise fed therebetween from the left at a predetermined pitch.

The chamfering die needs not to be part of a set of progressive dies, and can be a separate chamfering die, in which case it would be a dedicated chamfering die.

The products 7 are formed from the sheet material 9, which is made of cold-rolled steel sheet, by punching in the material 9 a plurality of radially arranged slits 11, as shown in slit punching step Sa of FIG. 2, after which at step Sb a chamfer 13 is formed simultaneously at both surfaces of the sheet material 9 at an edge part of each slit 11, after which the products 7 are formed as rings. The chamfer 13 is formed after the slits 11 are punched out, by applying forces to the upper and lower surfaces of the edge of the slit 11, so as to form an inclined surfaces thereat. It should be noted that the shape of the chamfer 13 can also be rounded.

Figure 3:
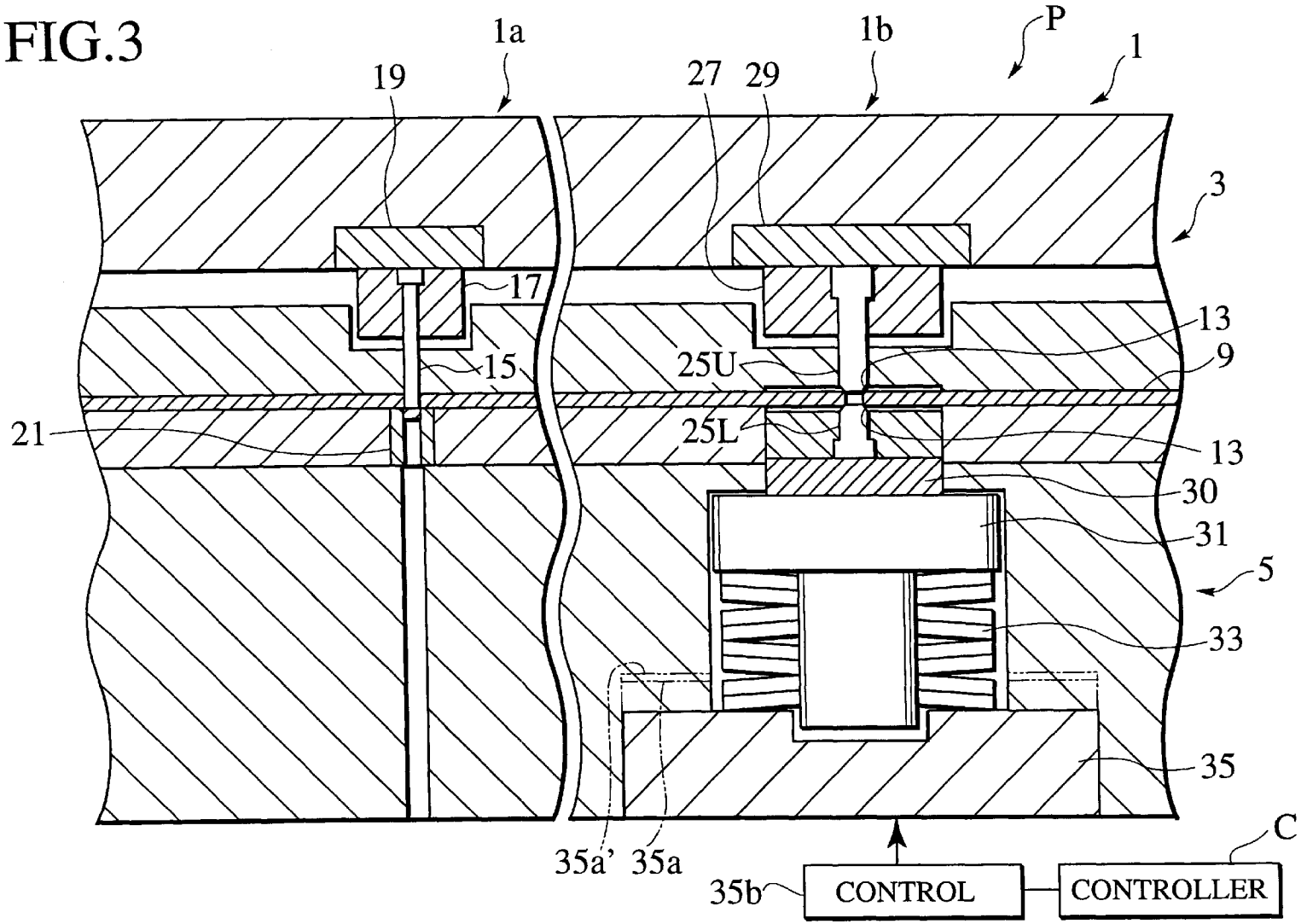
FIG. 3 is a longitudinal section of an essential portion of a die assembly of the press of FIG. 1.

The left half of FIG. 3 shows the slit blanking die section 1*a* of the chamfering die 1. The upper die 3 is provided with a slit punch 15, a punch plate 17, and a pressure-receiving plate 19, these elements rising and falling in concert with the upper die 3. The fixed lower die 5 has a slit block 21, which opposes the slit punch 15 of the upper die 3. The left half of FIG. 3 shows the condition in which the slit punch 15 has been lowered, and the slits 11 have been punched out.

The right half of FIG. 3 shows the chamfering die section 1*b* of the chamfering die 1. The upper die 3 in this die section 1*b* is provided with a chamfering punch 25U, a punch plate 27, and a pressure-receiving plate 29, these elements rising and falling in concert with the upper die 3. Chafers 13 on both sides are designed to be identical. The lower die 5 has a lower chamfering punch 25L, which opposes the upper chamfering punch 25U, a pressure-receiving plate 30 and a guide 31 both supported in a floating manner on a bed 35 by a plurality of disc springs (resilient members) 33. The lower chamfering punch 25L and the lower die 5 receive an initial upward-directed load by means of the disc springs 33 and, as the upper chamfering punch 25U is lowered, although the applied force increases with an increase in the flexure of the disc springs 33, this is limited by a resilient biasing force of the disc springs 33 at the point at which the upper chamfering punch 25U reaches a bottom dead point, and does not exceed this force. The right half of FIG. 3 shows the condition in which the upper chamfering punch 25U has reached the bottom dead point, at which the chamfer 13 is formed in the slits 11.

The bed 35 may have a raised top level 35*a*, and a position control 35*b* as means under control of the controller C or to be manually operated for controlling a vertical position of the bed 35 within a control range between 35*a* and 35*a*', to adjust the spring rate of springs 33 that may slightly vary with time.

It is possible to adopt a structure in which the disc springs are provided not on the lower die but on the upper die 3, in which case the lower die is raised. Additionally, although the above embodiment is for the case in which the pressure receiving plate 30 and guide 31 are separate elements, these can be formed as one. It is also possible to use disc springs on both the upper and lower dies.

It should be noted that a resilient biasing means other than a disc spring can be used. For example, it is possible to impart this force by means of air.

Figures 4A, 4B, 4C, 4D:
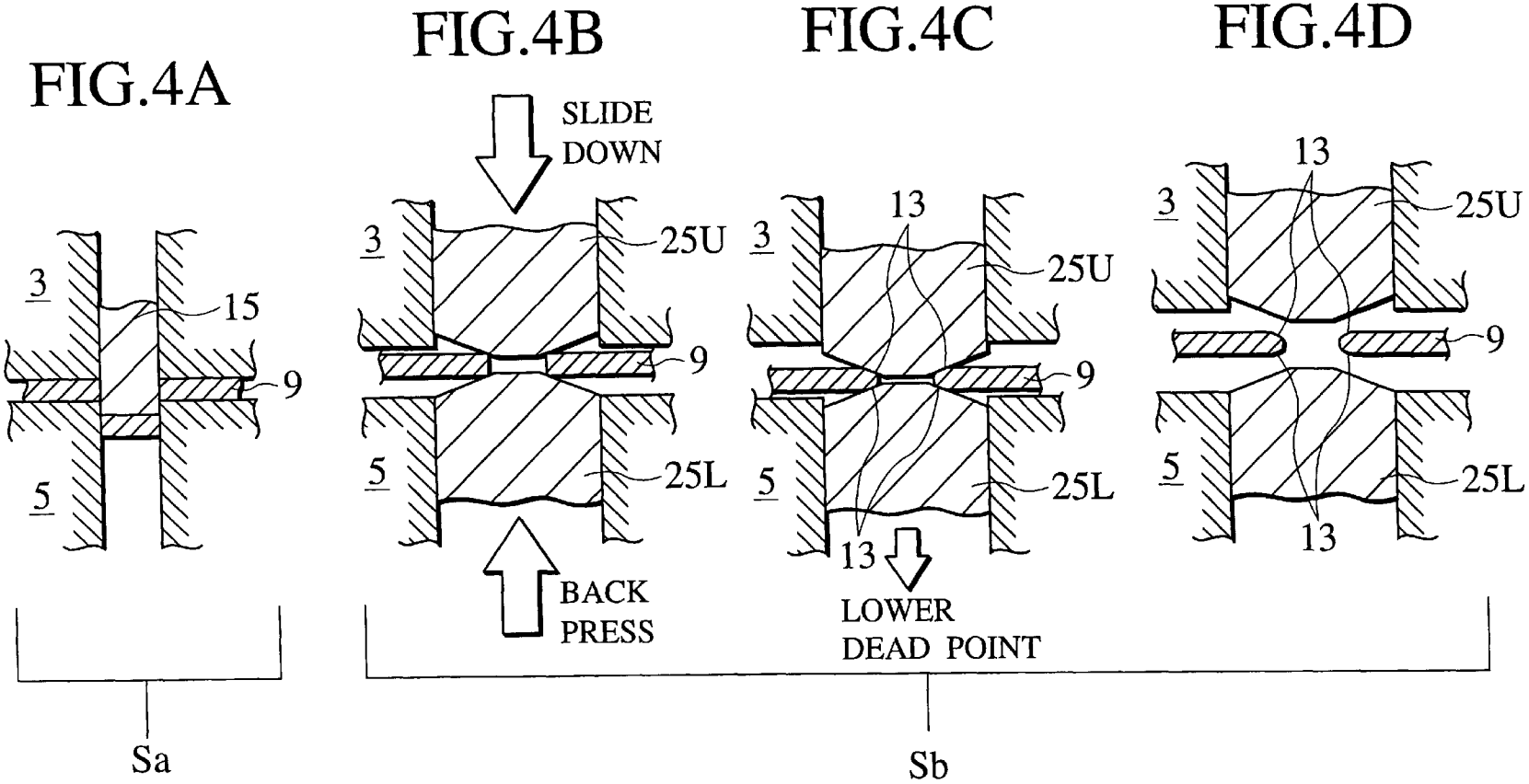
FIGS. 4A to 4D are illustrations of steps of a chamfering process according to an embodiment of the invention.
Figure 5:
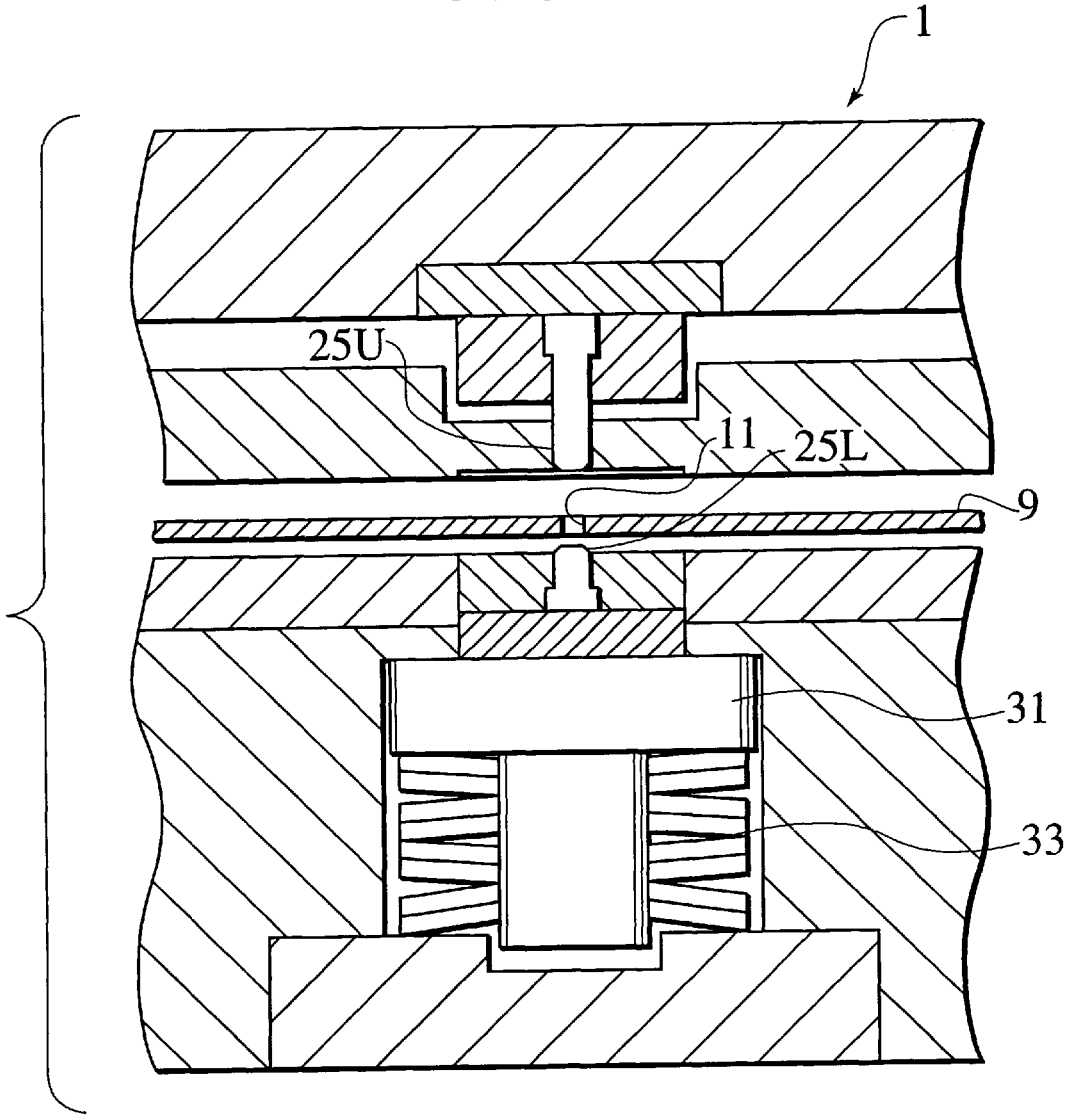
FIGS. 5 to 7 are sections of essential portions of the press, illustrating operations thereof associated with the chamfering process of FIGS. 4A to 4D.
Figure 6:
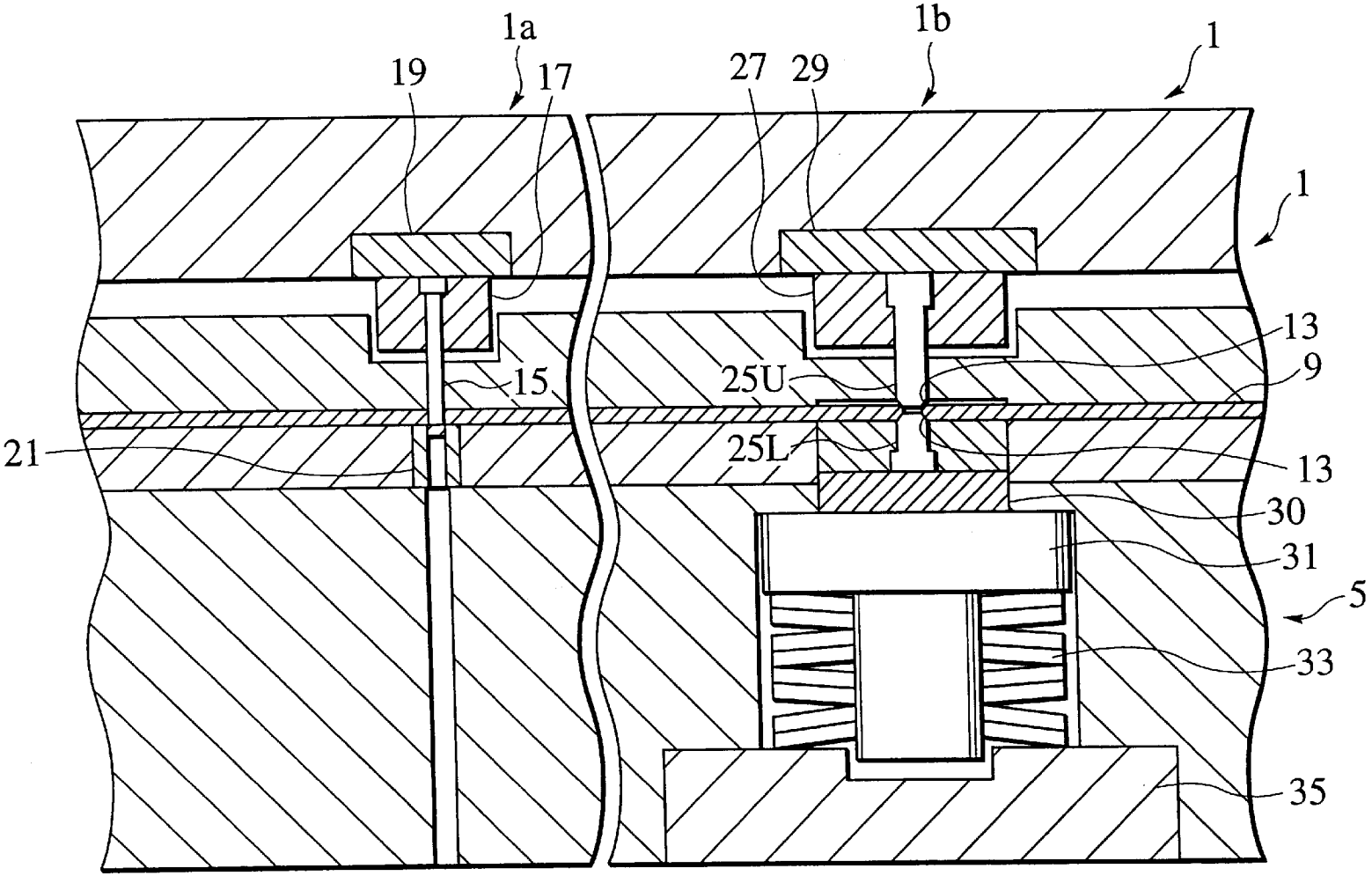
Figure 7:
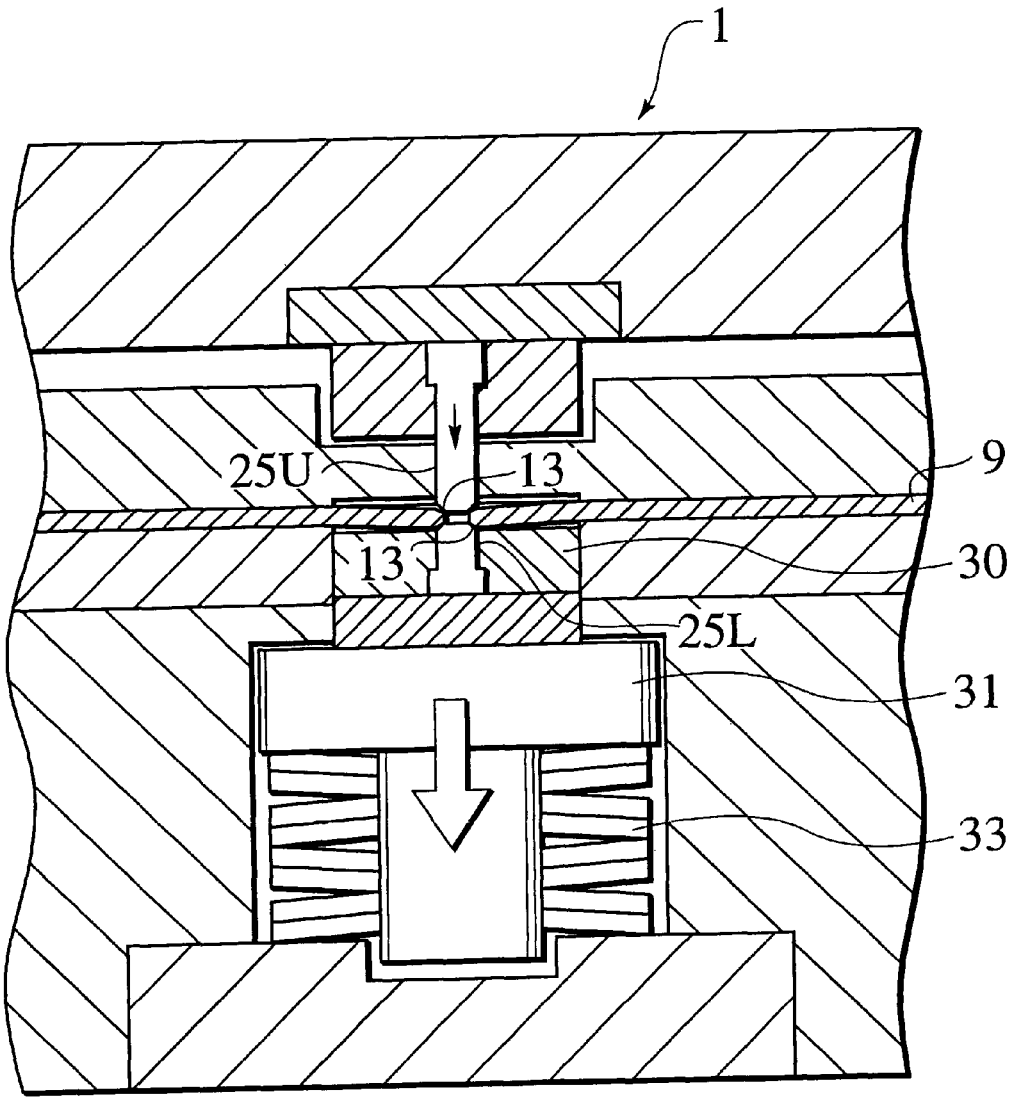

Next, a method for punching out the product 7 and performing chamfering thereof using the die 1 will be described with reference to FIGS. 2, 4A to 4D and 5 to 7. FIG. 4A illustrates the step Sa of FIG. 2, and FIGS. 4B to 4D illustrate three sub-steps of the step Sb of FIG. 2. FIGS. 5 to 7 describe positions and operations of the die 1 associated with FIGS. 4B to 4D.

The belt-shape material 9. having a width that is appropriate for a designed external dimension of the product 7, is supplied to the die 1 from left to right, at a predetermined pitch that is also appropriate to this diameter. At step Sp, a pilot punch punches a pilot hole 9*a* at the predetermined pitch, with subsequent process steps performed using the position of this pilot hole 9*a* as a reference. At step Sq, a slot 9*b* is provided to avoid interference from process steps at adjacent positions on the sheet material 9.

Next, at step Sa, slits 11 are punched out of the product 7 in a radial pattern, and at step Sb, chamfers 13 are formed at the edges of the slits 11. Then, steps Sr, Ss of punching out the inner and outer diameters of the product 7 are performed, the latter step Ss causing the product 7 to be punched out of the sheet material 9 so that the product 7 can be discharged at step St.

As in FIG. 4A, the slits 11 are punched out at the step Sa (FIG. 4A).

Then, at the chamfering step Sb, the upper chamfering punch 25U is first lowered from its position shown in FIG. 5, so as to come into contact with the edge of the slits 11. When this occurs, as in FIG. 6, the initial force of the disc spring 33 that impels the lower chamfering punch 25L is applied (FIG. 4B).

When the upper chamfering punch 25U is further lowered, as in FIG. 7, the spring disc 33 flexes in accordance with the amount of downward movement of the upper chamfering punch 25U, so that the force applied increases, the chamfer 13 being formed when the upper chamfering punch 25U reaches the bottom dead point (FIG. 4C).

Then the upper chamfering punch 25U rises to an initial position (FIG. 4D), with which the bottom face of the upper die 3 has a higher level than that in FIG. 4B while the top face of the lower die 5 remains at an identical level to that in FIG. 4B.

In this manner, the pressure applied by the chamfering punches 25U and 25L in the chamfering step is softened in comparison with the case in which the lower chamfering punch 25L of the lower die 5 is fixed.

Figure 8:
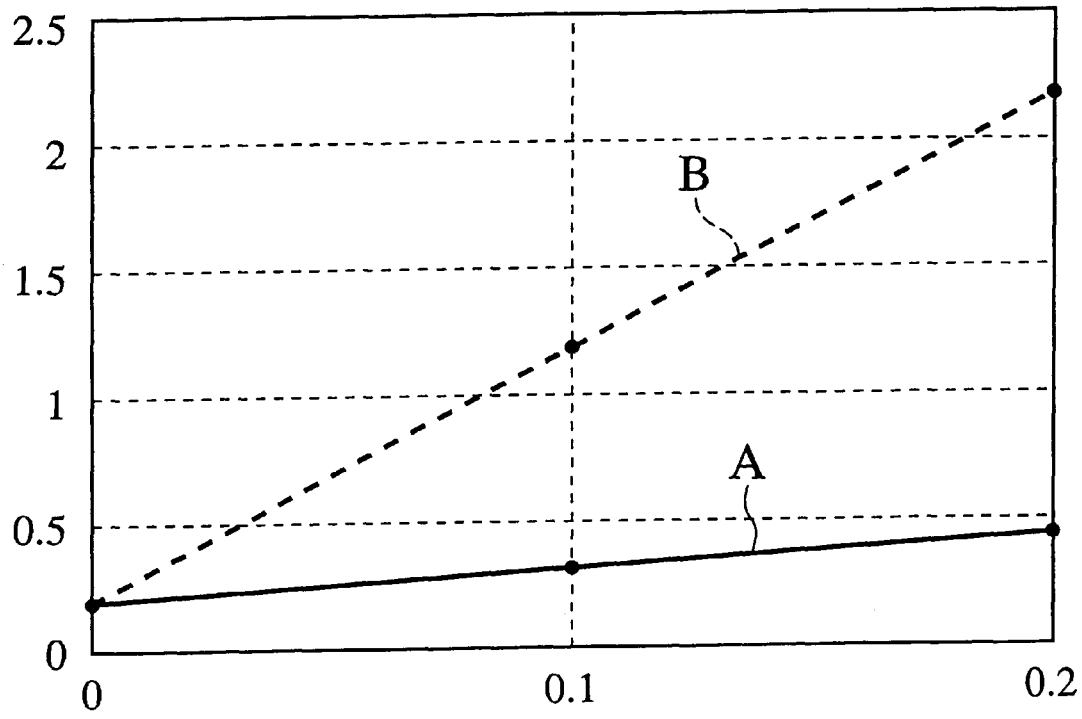
FIG. 8 is a graphical presentation of a performance of the press of FIG. 1.

FIG. 8 shows the influence that variations in the bottom dead point of the upper chamfering punch 25U have on the chamfer dimensions. The vertical axis represents the downward offset of the bottom dead point of the upper chamfering punch 25U from the reference position (shown as the 0 point in the drawing), and the horizontal axis represents the width dimension of the chamfer as seen in a plan view thereof. The solid line A is an actual measurement of this embodiment, while the broken line B indicates the second related art, in which the lower chamfering punch was fixed. As can be seen from this drawing, there is a great reduction in the variation of the width dimension of the chamfer with respect to variation in the bottom dead point of the upper chamfering punch 25U.

According to this embodiment of the invention, by using a structure in which the lower chamfering punch 25L is supported in a floating manner by using disc springs 33, it is possible to greatly limit the influence of variations in the bottom dead point of the upper chamfering punch 25U, the result being not only a limitation in the dimensional variations of the upper and lower chamfers, but also an improvement in ease of production, without the trouble of carefully controlling the accuracy of the bottom dead point of the upper chamfering punch 25U.

Additionally, by using a simple construction that employs disc springs 33, it is possible to limit the increase in cost.

Another member to which the invention can be applied is a buckle for a seat belt used in a vehicle. By using a die according to the invention with such as buckle, sharp edges at the front and back surfaces of the belt-looping hole are removed, thereby preventing interference with proper operation of the seat belt.

It should be noted that, while the product 7 in the above-noted embodiment is a thin sheet, the invention is not restricted to thin sheets, and can be widely applied to sheet and plate items and products that require the removal of burr.

Even if there is a slight increase in the stroke of a first punch of a pair of chamfering punches, the flexure of a resilient member that impels the second punch limits the increase in applied force, thereby not only limiting dimensional variations in the chamfer, but also providing an improvement in ease of production, without the trouble of carefully controlling the stroke of the first punch.

The embodiment limits an increase in cost by using a simple construction that employs disc springs.

Specifically, the embodiment is a die that simultaneously forms chamfers at corners on both sides of a member using a pair of chamfering punches to apply force thereto, wherein one of the pair of chamfer dies is impelled by a resilient member.

Because of the above-noted arrangement, even if the stroke of the other punch of the pair of chamfer punches becomes slightly larger, because of the flexure in the resilient element that impels the opposing punch, not only is there a limiting of the increase in applied force, but also an improvement in ease of production, without the need to be concerned with the need to control the accuracy of the stroke of the other punch.

A simple structure that uses a disc spring enables limiting of the increase in cost.

There is performed simultaneous chamfering of both comers at both surfaces of a member, using the chamfering die.

While preferred embodiments of the invention have been described using specific terms, such description is for illustrative purposes, and it is to be understood that changes and variations may be made without departing from the spirit or scope of the following claims.

What is claimed is:

1. A chamfering method comprising:

supporting a material by first and second resilient forces acting on opposite sides of the material, wherein said first and second forces balance each other; and chamfering the opposite sides of the material using the first and second forces.

2. The chamfering method of claim 1, wherein the material comprises a plate material, and wherein said chamfering method further comprises:

forming a first chamfer on one side of the plate material using a first chamfering element receiving the first resilient force;

forming a second chamfer on another side of the plate material using a second chamfering element receiving the second resilient force.

3. The chamfering method of claim 2, wherein said first and second chamfers are symmetrical to each other.

4. A chamfering system comprising:

a support mechanism for supporting a material with first and second resilient forces acting on opposing sides of the material and balancing each other; and a chamfering mechanism for chamfering the opposing sides of the material by using the first and second resilient forces.

5. The chamfering system of claim 4, wherein the material comprises a plate material, and wherein said chamfering mechanism has a first chamfering element receiving the first resilient force to form a first chamfer on one side of the plate material, and a second chamfering element receiving the second resilient force to form a second chamfer on another side of the plate material.

6. The chamfering system of claim 5, wherein the first and second chamfers are symmetrical to each other.

7. The chamfering system of claim 5, wherein said support mechanism comprises a disc spring for generating the first and second resilient forces.

8. The chamfering system of claim 7, wherein said support mechanism further comprises means for adjusting position of said disc spring.

9. A press for simultaneously forming chamfers at edges on both sides of a material using a pair of chamfering punches to exert chamfering pressures thereon, wherein the pair of chamfering punches exert, on the edges of the both sides of the material, first and second resilient chamfering pressure that balances each other to form the chamfers and to support the material.

10. A chamfering system comprising:

a chamfering mechanism for chamfering a material; and a support mechanism for resiliently supporting the material to be chamfered by the chamfering mechanism, wherein the material comprises a plate material, wherein said chamfering mechanism has a first chamfering element for chamfering one side of the plate material, and said support mechanism includes:

a second chamfering element for chamfering an opposite side of the plate material, and a resilient member for resiliently supporting said second chamfering element, and wherein said resilient member includes a conical disc spring.

11. A chamfering system according to claim 10, wherein said support mechanism further comprises means for adjusting a position of said resilient member.

* * * * *